US005090756A

United States Patent [19]

Pfisterer

[11] Patent Number: 5,090,756

[45] Date of Patent: Feb. 25, 1992

[54] MATERIAL COMPACTING DEVICE

[75] Inventor: Dieter E. Pfisterer, Wyckoff, N.J.

[73] Assignee: Pfister Enterprises, Inc., Hawthorne, N.J.

[21] Appl. No.: 525,497

[22] Filed: May 18, 1990

[51] Int. Cl.[5] ..... B65B 67/12

[52] U.S. Cl. ..... 294/1.1; 294/55; 248/95

[58] Field of Search ..... 294/1.1, 1.4, 55; 141/108, 109, 390, 391; 248/95, 99, 101; 383/33, 34, 34.1, 904

[56] References Cited

U.S. PATENT DOCUMENTS

| | | | |
|---|---|---|---|
| 544,461 | 8/1895 | Cotter | 248/101 |
| 579,228 | 3/1897 | Frame | 141/390 |
| 1,088,633 | 2/1914 | Simmons et al. | 248/95 X |
| 1,554,550 | 9/1925 | Berger | 248/95 X |
| 3,983,914 | 10/1976 | Benson | 294/1.1 X |
| 4,037,778 | 7/1977 | Boyle | 248/99 X |
| 4,629,233 | 12/1986 | Pfisterer | 294/1.1 |
| 4,759,519 | 7/1988 | Cheng | 294/1.1 X |

*Primary Examiner*—Margaret A. Focarino
*Assistant Examiner*—Dean J. Kramer
*Attorney, Agent, or Firm*—Klauber & Jackson

[57] ABSTRACT

A device for compacting and containing compactible material, includes a collapsible directing element having an entrance funnel section which converges into an exit section of smaller dimensions than said entrance funnel section, the funnel section including a hole therein; a clamp strap for clamping a netting material on the exit section; restraining straps for securing the clamp strap on the directing element, the restraining straps being connected between the directing element and the clamp strap; and an elongated cord for preventing movement of the directing element during a compacting operation, the elongated cord having a first end connected to the directing element at the hole and a second free end extending forwardly of the entrance funnel section and which can be engaged by a person for preventing movement of the directing element.

14 Claims, 8 Drawing Sheets

MATERIAL COMPACTING DEVICE

BACKGROUND OF THE INVENTION

The present invention relates to a material compacting device, and more particularly, is directed to a device for compacting and bundling leaves and grass.

Generally, during spring and fall clean-ups of lawn areas and the like, leaves, grass and other yard materials are collected together by raking the lawn area so as to assemble the materials into discrete piles. Thereafter, the materials are deposited in plastic bags by hand, rake or both. However, such materials are generally of a relatively light weight and are not actually compacted, leaving a great deal of air trapped between the leaves. As a result, a significant amount of wasted space is provided in each bag so that a relatively small amount of leaves and the like are packed in each bag. This is therefore extremely inefficient and requires the use of numerous plastic bags.

Further, such procedure is slow since only a small quantity of leaves is insertible in the open trash bags at one time and the bags do not allow entrapped air to escape. Also, since the plastic bags are not biodegradable, the leaves and other organic materials contained in the bags are not rendered biodegradable, which presents problems to the municipality or other government entity charged with the disposal of such materials.

Accordingly, it is known from U.S. Pat. No. 4,629,233 to the same inventor herein to provide a material compacting device which overcomes these deficiencies. Specifically, a leaf directing element has a front funnel section and an open rear conduit. An expanded annular ring or lip is provided at the open rear conduit of the leaf directing element. Accordingly, netting material is held on the open rear conduit by an elastic band, with the opposite closed end of the netting material extending outwardly therefrom. A special plunger-type rake forces the leaves through the enlarged funnel section and out the open rear conduit, into the netting material. Continued compression of leaves therethrough forces the netting material to be slowly pulled outwardly in order to contain more compacted leaves. When sufficient compacted leaves have been inserted in the netting material for the particular purpose, the netting material at the rear conduit is cut and tied.

However, it has been found from practical usage that various problems may result with this arrangement. Specifically, in order to maintain the netting material on the rear conduit, the aforementioned annular ring provides a barrier against which the elastic band abuts when the netting material is pulled outwardly so as to provide a resistive force for the above mentioned compression and thereby to permit the netting material to pull outwardly in a slow manner. However, it has been found that if sufficient force is applied by the user, the elastic band tends to escape over the annular ring. Once this occurs, there is nothing holding the netting material onto the rear conduit so that compaction of leaves, grass and the like in the netting material will not occur thereafter.

Further, the leaf directing element itself is relatively bulky to store during non-use periods. As discussed above, primary usage of the material compacting device of this Patent will occur during spring and fall clean-up operations on lawn areas. During the remaining periods of the year, the material compacting device is not in use and is relatively bulky to store. In addition, because of the bulkiness of the product, shipping costs are relatively expensive. Lastly, in order to prevent movement of the leaf directing element during use, an anchor rod or nail is inserted through a hole in the device into the ground so as to temporarily secure the leaf directing element in the ground. Although this anchoring operation can easily occur in soft ground, the device cannot be used in hard ground areas, such as streets, driveways and the like.

OBJECTS AND SUMMARY OF THE INVENTION

Accordingly, it is an object of the present invention to provide a material compacting device that avoids the aforementioned problems with the prior art.

It is another object of the present invention to provide a material compacting device that maintains the netting material thereon, even in the presence of large compaction forces, while providing a resistance for the compaction of leaves and the like.

It is still another object of the present invention to provide a material compacting device in which the resisting force on the netting material for compaction, is adjustable.

It is a further object of the present invention to provide a material compacting device which is collapsible for storage and shipping.

It is a still further object of the present invention to provide a material compacting device which permits use on hard or soft ground surfaces.

In accordance with an aspect of the present invention, a device for compacting and containing compactible material, includes a directing element having an entrance funnel section which converges into an exit section of smaller dimensions than said entrance funnel section; clamp means for clamping a netting material on the exit section; and restraining means for securing the clamp means on the directing element, the restraining means being connected between the directing element and the clamp means.

In accordance with another aspect of the present invention, a device for compacting and containing compactible material, includes a collapsible directing element having an entrance funnel section which converges into an exit section of smaller dimensions than the entrance funnel section; and clamp means for clamping a netting material on the exit section.

In accordance with still another aspect of the present invention, a device for compacting and containing compactible material, includes a directing element having an entrance funnel section which converges into an exit section of smaller dimensions than the entrance funnel section, the directing element including securing means thereon; clamp means for clamping a netting material on the exit section; and elongated means for preventing movement of the directing element during a compacting operation, the elongated means having a first end connected to the securing means of the directing element and a second free end extending forwardly of the entrance funnel section and which can be engaged by a person for preventing movement of the directing element.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
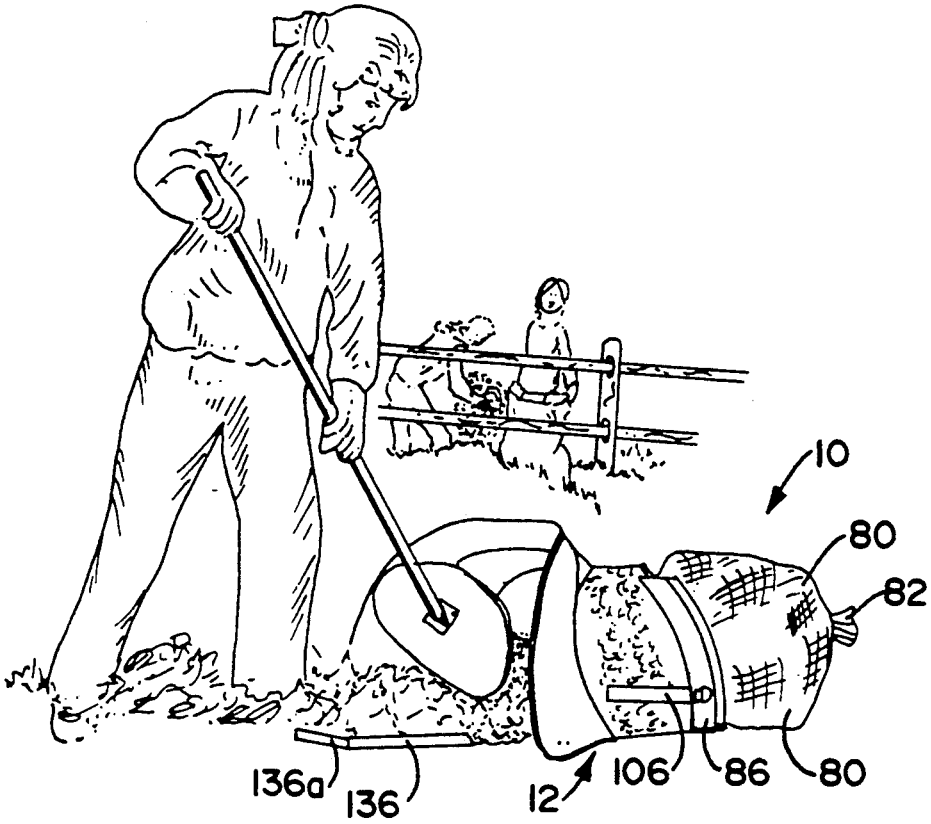
FIG. 1 is a front perspective view of a material compacting device according to the present invention, shown in use.
Figure 2:
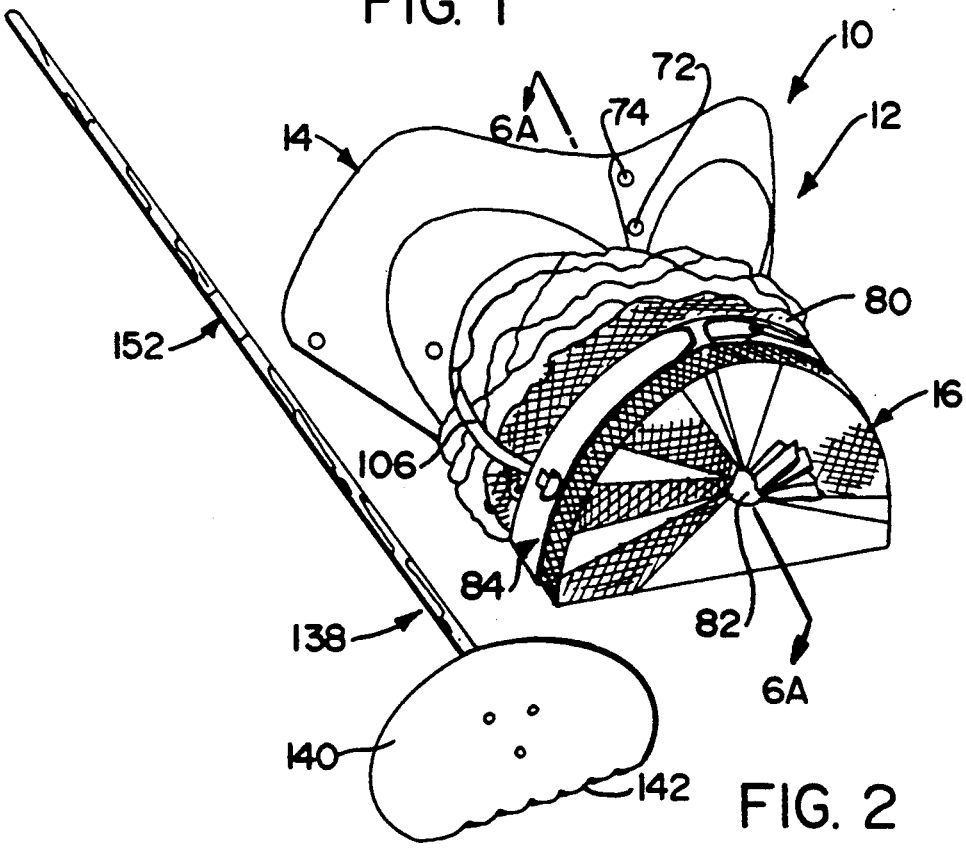
FIG. 2 is a rear perspective view of the material compacting device of FIG. 1.

Referring to the drawings in detail, and initially to FIGS. 1 and 2 thereof, a material compacting device 10 according to the present invention includes a leaf directing element 12 having an entrance funnel section 14 which converges into an exit section 16 of smaller dimensions than entrance funnel section 14.

Figure 3:
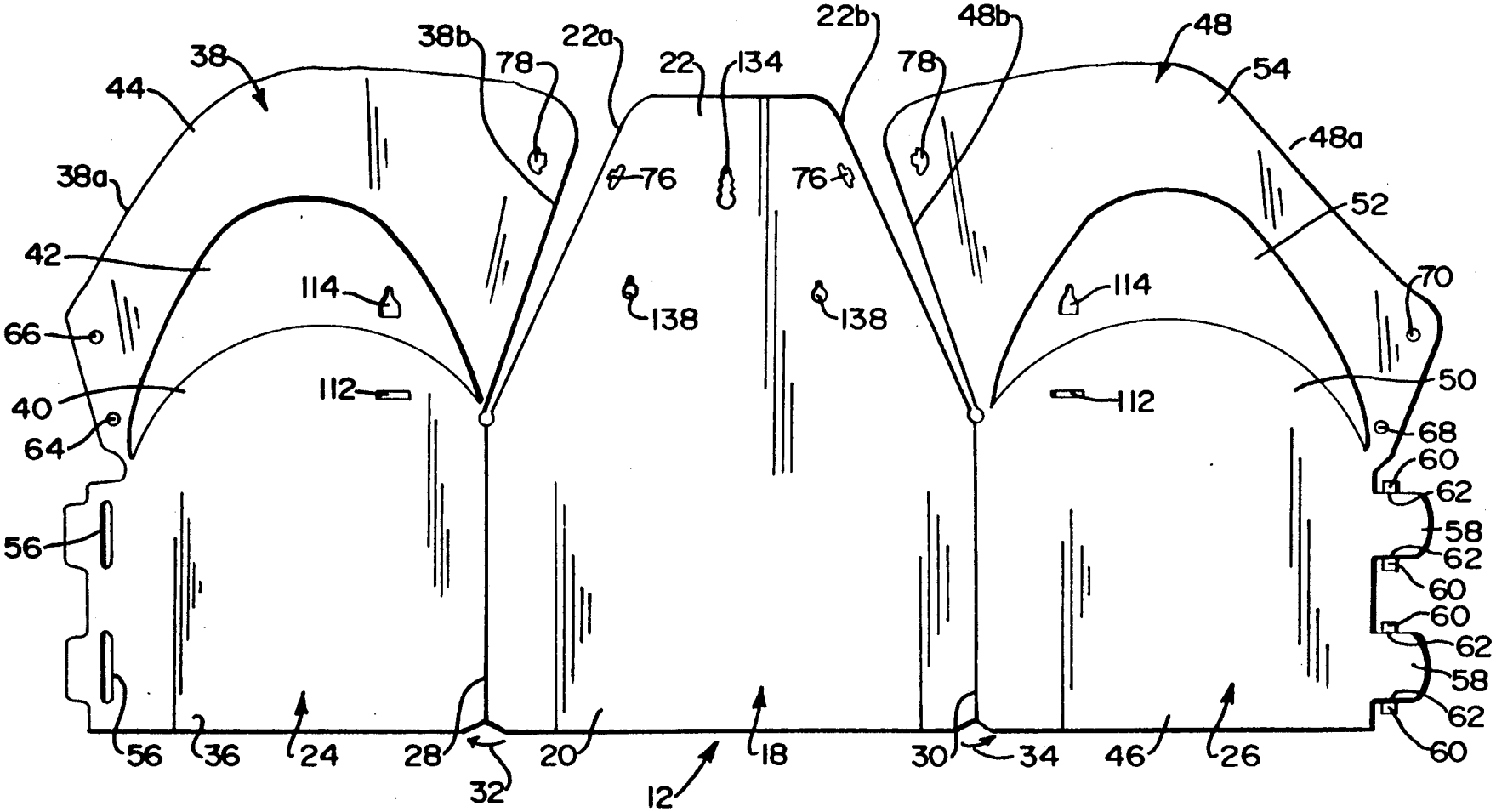
FIG. 3 is a plan view of the leaf directing element of the material compacting device, shown in a flattened condition.

In accordance with an aspect of the present invention, leaf directing element 12 is collapsible for storage and shipping. Specifically, as shown in FIG. 3, leaf directing element 12 is formed with a base panel 18 having a substantially rectangular rear section 20 which forms part of exit section 16 and an integrally formed front section 22 with a substantially truncated triangular configuration. Base panel 18 is substantially flat so that leaf directing element 12 can rest firmly on the ground or on other horizontal surface. Leaf directing element 12 further includes first and second side panels 24 and 26 integrally formed at side edges of rectangular rear section 20 along fold lines 28 and 30, respectively. Thus, side panels 24 and 26 can be folded in the directions of arrows 32 and 34, respectively, in order to form leaf directing element 12.

Side panel 24 has a substantially rectangular rear section 36 connected at a side edge thereof with the respective side edge of rear section 20 of base panel 18, that is, along fold line 28. In addition, side panel 24 includes a substantially parallelogram shaped front section 38 integrally formed with rear section 36 and having side edges 38*a* and 38*b* with an inclination similar to that of side edge 22*a* of front section 22. However, side edge 38*b* is not connected with side edge 22*a*. In addition, it will be appreciated that front section 38 is formed from three differently angled portions 40, 42 and 44 which, in assembled condition, form the enlarged entrance portion for funnel section 14, as shown clearly in FIGS. 1, 2, 6A and 6B, so as to permit easy entry of leaves and the like into leaf directing element 12.

In like manner, second side panel 26 includes a substantially rectangular rear section 46 integrally formed at fold line 30 with rear section 20 of base panel 18. Side panel 26 further includes a front section 48 integrally formed with rear section 46 and having a substantially parallelogram configuration, with side edges 48*a* and 48*b* inclined at an angle similar to that of side edge 22*b* of front section 22 of base panel 18. It will be appreciated that, although side edge 48*b* is adjacent to side edge 22*b*, it is not connected therewith. In addition, front section 48 is formed from three differently angled portions 50, 52 and 54, with a similar angulation to angled portions 40, 42 and 44.

In this manner, when side panels 24 and 26 are folded along fold lines 28 and 30 in the direction of arrows 32 and 34, respectively, and secured together, leaf directing element 12 is formed. In order to secure side panels 24 and 26 together to form leaf directing element 12, side panel 24 is formed with two slots 56 immediately adjacent the edge of rear section 36 which is opposite fold line 28, and substantially parallel thereto. The edge of side panel 26 opposite fold line 30 is formed with two spaced, substantially rectangular tabs 58 which are dimensioned to fit within slots 56. Each tab 58 includes opposite wings 60 integrally formed at opposite side edges thereof along fold lines 62.

Figure 4:
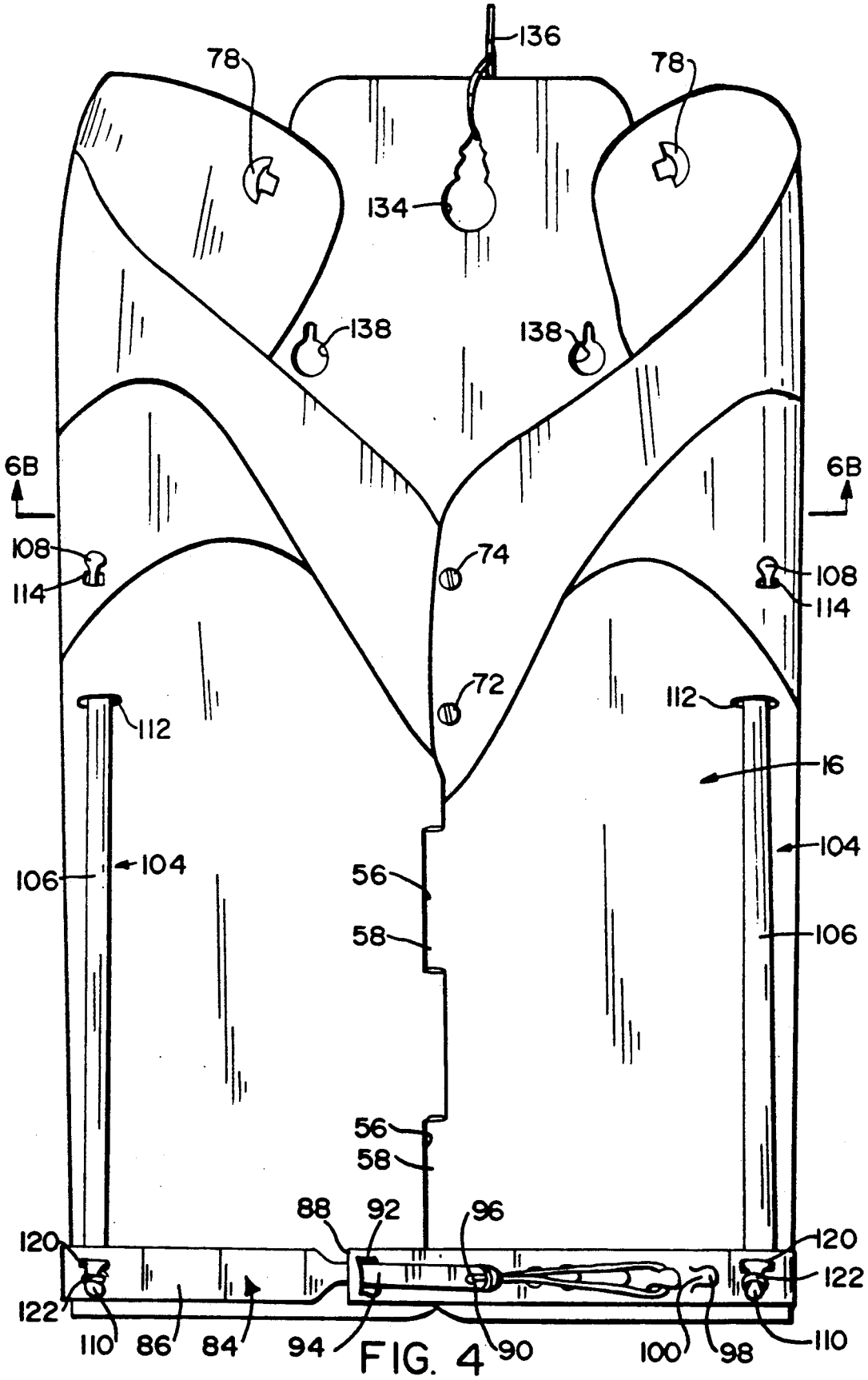
FIG. 4 is a top plan view of the material compacting device of FIG. 2.
Figure 5:
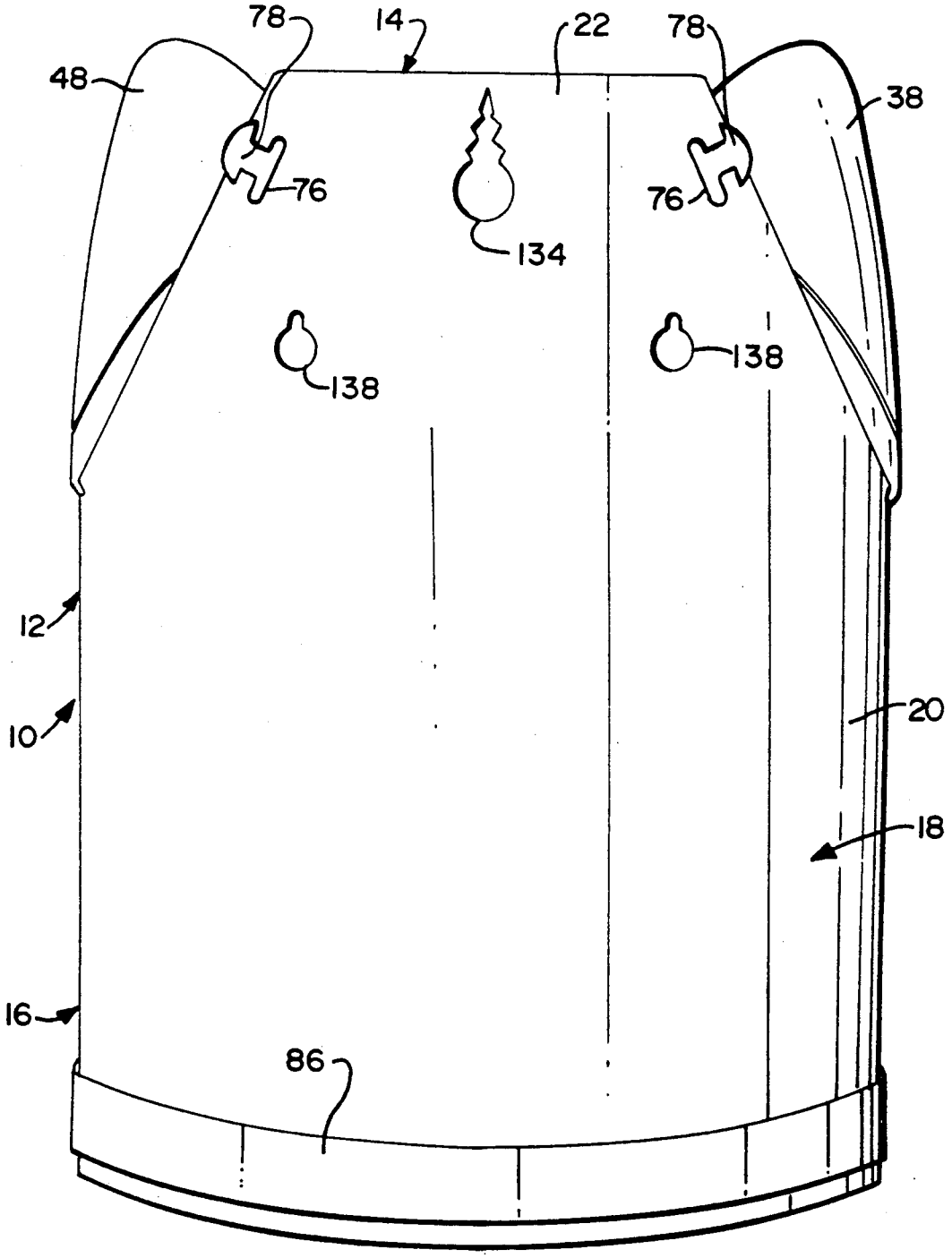
FIG. 5 is a bottom plan view of the material compacting device of FIG. 2.
Figure 6A:
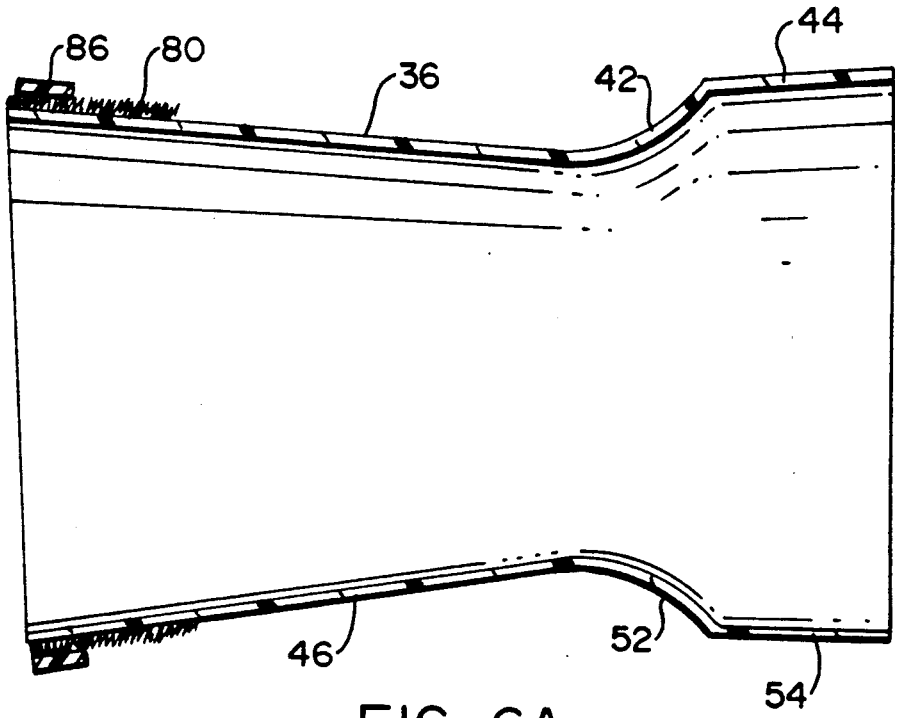
FIG. 6A is a cross-sectional view of the material compacting device of FIG. 2, taken along line 6A—6A thereof.
Figure 6B:
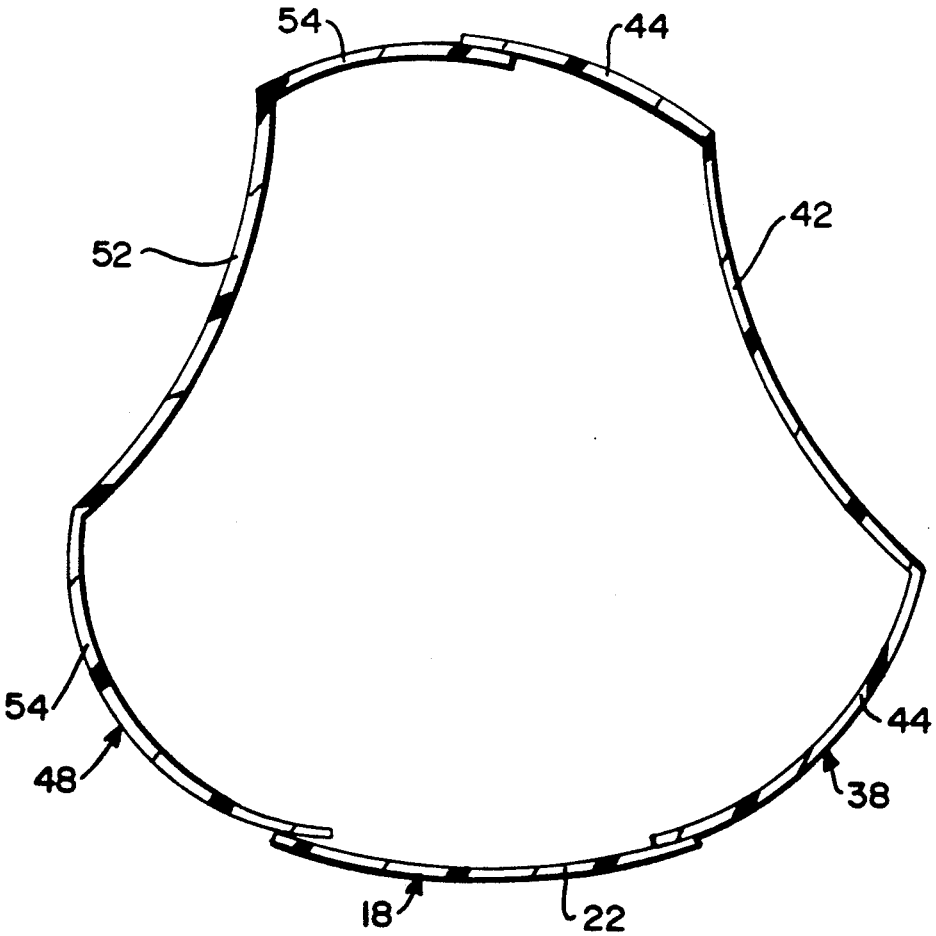
FIG. 6B is a cross-sectional view of the material compacting device of FIG. 4, taken along line 6B—6B thereof.

To removably secure side panels 24 and 26 together, wings 60 are folded along fold lines 62 from the position shown in FIG. 3 so as to lie immediately above their respective tabs 58, and then each tab 58 with its folded wings 60 is inserted through the respective slot 56. Upon insertion through the respective slot 56, wings 60 are again folded outwardly to the position shown in FIG. 3 so as to retain tabs 58 within slots 56, and thereby removably secure side panels 24 and 26 together In addition, front sections 38 and 48 are formed with holes 64, 66, 68 and 70 at lower inclined portions of side edges 38*a* and 48*a*. After tabs 58 have been secured within slots 56, holes 64 and 68 are placed in alignment with each other and a nut and bolt assembly 72 is secured therein. In like manner, holes 66 and 70 are placed in alignment, and a nut and bolt assembly 74 is secured therein, as shown in FIG. 4, to removably secure side panels 24 and 26 together.

Figure 7:
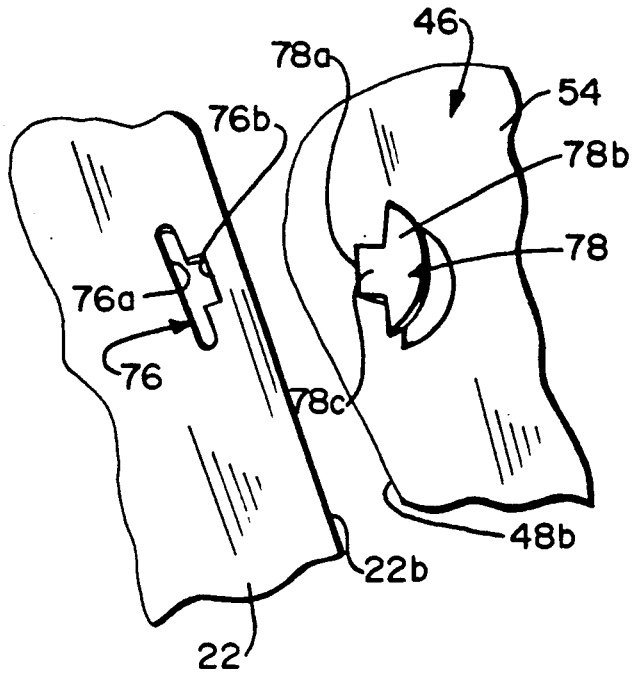
FIG. 7 is a perspective view of a portion of the material compacting device of FIG. 2 at the entrance funnel section thereof.

Finally, front section 22 of base panel 18 is formed with openings 76 adjacent each side edge 22*a* and 22*b*. As shown best in FIG. 7, each opening has an elongated oval shaped section 76*a* and a smaller rectangular section 76*b* in open communication with oval shaped section 76*a* at a longer side thereof. In correspondence therewith, as also shown in FIGS. 3 and 7, a mushroom-shaped tab 78 is punched or cut out from front section 48 adjacent side edge 48*b*, but remains hingedly secured to front section 48 at the shorter edge 78*a* thereof. It will be appreciated that mushroom-shaped tab 78 is formed with an enlarged head 78*b* and a smaller base 78*c*, with edge 78*a* being formed at the bottom of base 78*c*. Base 78*c* is dimensioned to fit within rectangular section 76*b* of opening 76, while enlarged head 78*b* is dimensioned to fit within oval shaped section 76*a* of opening 76. In this manner, front section 48 of side panel 26 is biased toward front section 22, and mushroom-shaped tab 78 is inserted through oval shaped section 76*a* of opening 76. Once tab 78 is inserted through opening 76 and the external force is released, front section 48 is naturally biased away from front section 22 of base panel 18, whereupon base 78*c* lodges within rectangular section 76*b* of opening 76 to retain front section 48 of side panel 26 removably connected with front section 22 of base panel 18. The same operation is performed with respect to base panel 18 and side panel 24.

It will therefore be appreciated that, while leaf directing element 12 forms a relatively rigid structure in its assembled condition, leaf directing element 12 can be easily disassembled in the reverse order from that described above. As a result, leaf directing element 12 can be stored and shipped in a compacted form. For example, leaf directing element 12 can be stored in the form shown in FIG. 3. Alternatively, and preferable thereto, from the configuration of FIG. 3, side panels 24 and 26 are folded over base panel 18 in a collapsed position in order to provide an extremely compact storage and shipping form thereof. Specifically, from the position shown in FIG. 3, side panel 24 is folded over base panel 18 along fold line 28 and side panel 26 is folded thereover in the direction of arrow 34 along fold line 30. In such condition, side panels 24 and 26 are not secured to each other, and accordingly, lie substantially flat on base panel 18.

In accordance with the present invention, and in a generally similar manner to U.S. Pat. No. 4,629,233, a length of tubular plastic netting material 80 has one end inserted over rear section 16 of leaf directing element 12 and is bunched up thereon. The opposite end of netting material 80 is closed by any suitable means, such as tying the same in a knot 82. Such netting material is available in rolls containing several thousand feet of material in which the netting material measures, for example, 14" in diameter with a mesh size of approximately 1". One such netting material comprised of polyethylene is sold by the Conweb Company of Saint Louis, Missouri.

Accordingly, leaves, grass and the like are inserted through funnel section 14 and leave exit section 16 into netting material 80. As more leaves, grass and the like are inserted through funnel section 14, more netting material 80 is pulled away from exit section 16 to provide additional netting material for containing more leaves, grass and the like.

Figure 8:
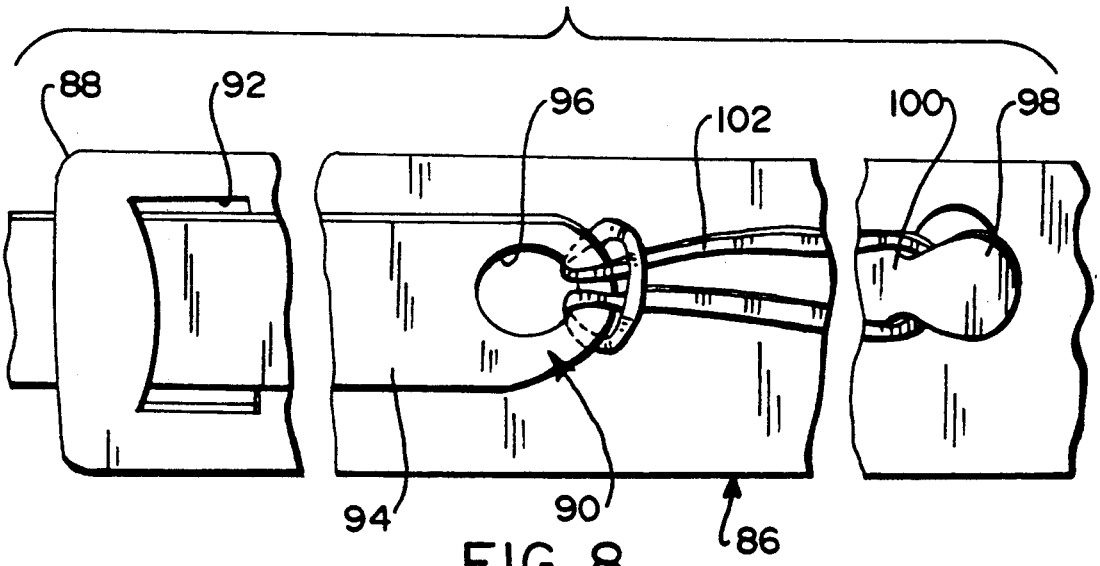
FIG. 8 is an enlarged perspective view of a portion of the clamp device for clamping a netting material on the exit section of the material compacting device.

In order to provide resistance to the netting for compaction of leaves, grass and the like therein, the aforementioned U.S. Pat. No. 4,629,233 to the same applicant herein provides an annular lip or ring at the rear conduit thereof, along with an elastic band secured over the netting material. However, as described above, oftentimes the elastic band will slip from the annular ring to permit free play or unraveling of the netting material from the leaf directing element, that is, eliminating any compaction resistance. In accordance with the present invention, a clamp device 84 in the form of a strap 86 is provided. Specifically, strap 86 includes a first free end 88 and a second opposite free end 90, as best shown in FIGS. 4 and 8. More particularly, free end 88 is provided with an opening 92 and free end 90 includes a reduced width end 94 which fits within opening 92. Free end 90 further includes a circular opening 96.

A plurality of part-circular tabs 98 are punched or cut from strap 86, in-line and spaced a distance from opening 92. Tabs 98, however, remain connected to strap 86 at connecting portions 100 thereof so that they face away from free end 88.

An endless elastic band 102 is looped, as shown in FIG. 8, through opening 96 so as to be secured thereto, and is stretched over one of tabs 98 so as to form strap 86 into a closed loop about exit section 16 of leaf directing element 12. In this manner, strap 86 provides a clamping action on netting material 80 to provide a resistance force thereto for compaction of leaves, grass and the like. Specifically, as leaves, grass and the like are compacted through leaf directing element 12, they force netting material 80 out from clamp device 84. The force necessary to permit release or pulling of additional netting material 80 will depend on which tab 98 is used with respect to elastic band 102. Thus, engagement of elastic band 102 over those tabs 98 closer to free end 88 will result in a lesser force required for releasing more netting material 80. As a result, the force of compaction is adjustable with the present invention.

Figure 9:
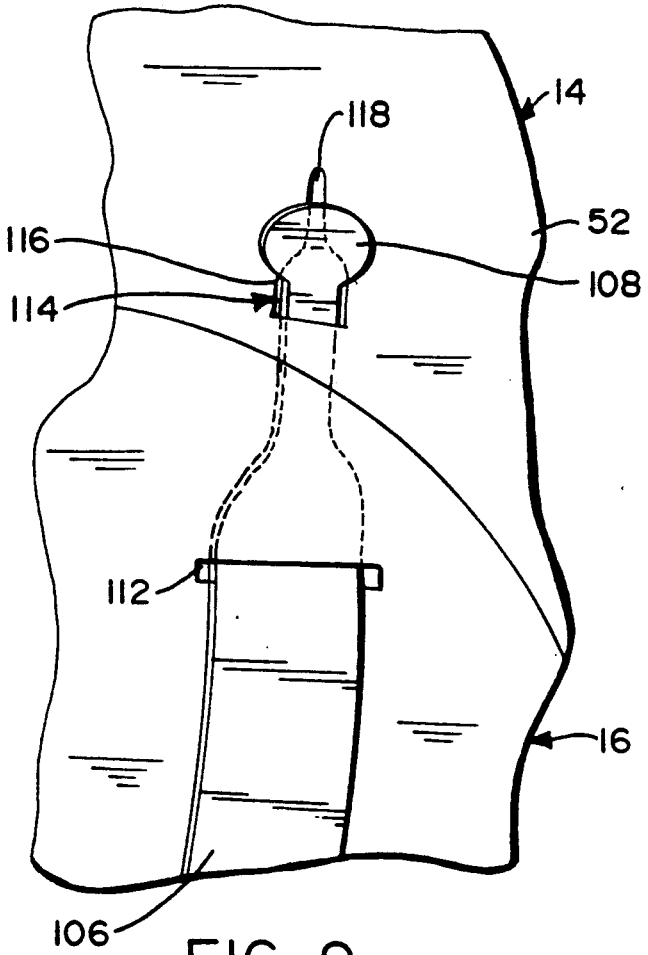
FIG. 9 is an enlarged perspective view of the front end of the restraining device for maintaining the clamp device on the leaf directing element.

In order to prevent clamp device 84 from being pulled off of leaf directing element 12 during compaction of leaves, grass and the like within netting material 80, a restraining device 104 is provided. Specifically, restraining device 104 includes two elongated, substantially diametrically positioned straps 106, each having enlarged heads 108 and 110 at opposite ends thereof. As best shown in FIGS. 4 and 9, each strap 106 extends along the outside of exit section 16 in the lengthwise direction of leaf directing element 12.

The forward end of each strap 106 extends through a slot 112 in exit section 16 so as to extend partially within leaf directing element 12. The forward free end of each strap 106 then extends outwardly of the apparatus through an opening 114 in the respective angled portion 42 or 52. As shown best in FIG. 9, opening 114 has a bottle shape with an enlarged base portion 116 and a narrow upper portion 118. The width of both base portion 116 and narrow upper portion 118 are less than the dimensions of enlarged head 108. However, the combined height of base portion 116 and narrow upper portion 118 is greater than that of enlarged head 108. Therefore, enlarged head 108 can be inserted through opening 114 by rotating the same 90 degrees from the position shown in FIG. 9, and then rotated back 90 degrees to the position shown in FIG. 9 in order to secure enlarged head 108 to leaf directing element 12.

Figure 10:
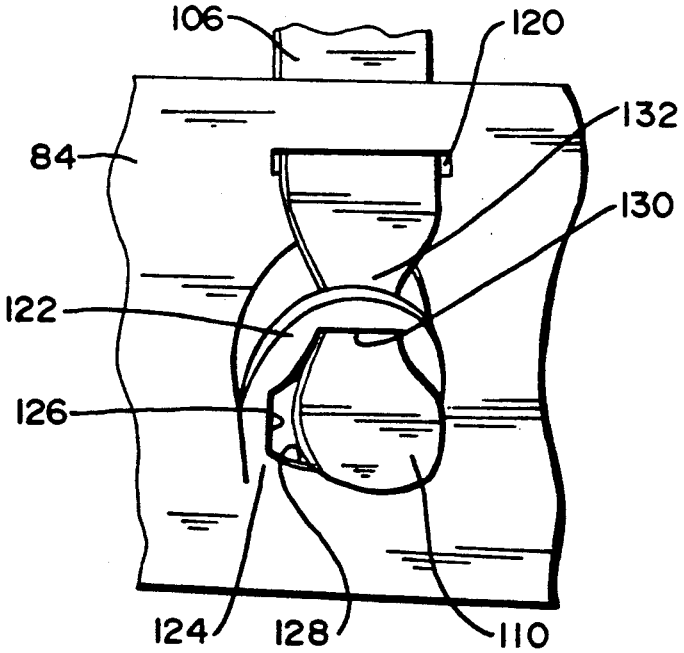
FIG. 10 is an enlarged perspective view of the rear end of the restraining device of FIG. 9.

As shown in FIGS. 4 and 10, strap 86 of clamp device 84 is provided with two substantially diametrically opposite slots 120 through which the rear end of each strap 106 extends. Immediately below each slot 120, strap 86 is provided with a punched or cut-out tab 122 of a substantially semi-circular configuration, but which remains secured to strap 86 by a connecting section 124. Each tab 122 is provided with an opening 126 having an enlarged rear portion 128 and a smaller forward portion 130. In addition, the rear end of each strap 106 is provided with a narrow neck 132 which connects enlarged head 110 to strap 106. Accordingly, each strap 106 extends through a slot 120 and then through an opening 126 such that, if a compacting force is applied which would tend to pull clamp device 84 off of leaf directing element 12, neck 132 becomes engaged within smaller forward portion 130 of opening 126 to retain clamp device 84 on leaf directing element 12. As such, each strap 106 is connected between leaf directing element 12 and clamp device 84.

Therefore, not only can the compacting force be adjusted by means of adjusting the tightness of strap 86, but also, strap 86 is prevented from escaping from leaf directing element 12, regardless of the force applied by the user.

As shown in FIGS. 1, 3 and 4, front section 22 of base panel 18 is provided with an opening 134, and a cord 136 or the like is secured to base panel 18 within such opening 134, cord 136 extending forwardly from leaf directing element 12. The free end 136*a* of cord 136 can be stepped on by a user while forcing leaves, grass and the like into leaf directing element 12, to prevent movement of leaf directing element 12 from the compacting force. It will be appreciated that this arrangement with cord 136 and opening 134 provides for use of material compacting device 10 on hard or soft surfaces. Alternatively, a rod or the like can be used in place of cord 136.

Further, front section 22 of base panel 18 is provided with two openings 138 which can be used to hang leaf directing element 12 on a hook or the like during non-use, rather than disassembling the same as mentioned above.

Figure 11:
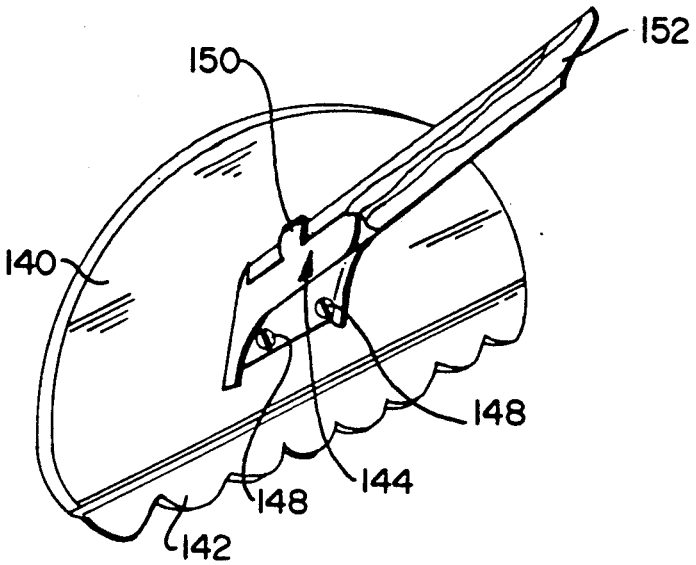
FIG. 11 is an enlarged rear perspective view of the plunger rake of FIG. 2.
Figure 14:
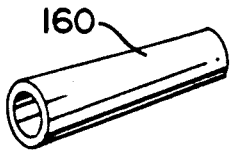
FIG. 14 is a perspective view of the tube for securing the handle sections of the plunger rake together.
Figure 13:
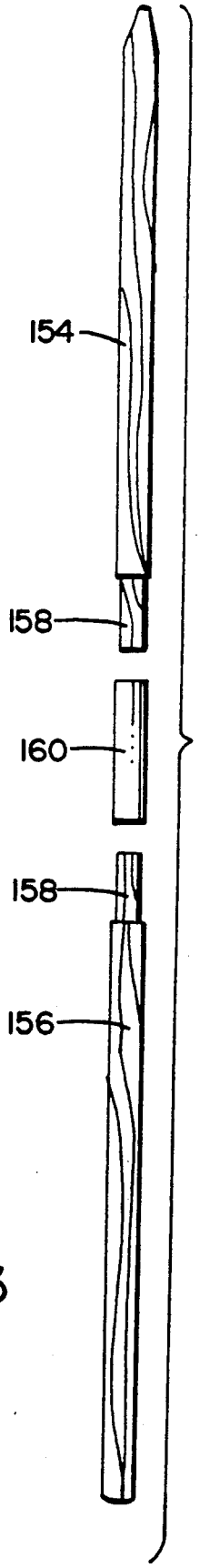
FIG. 13 is a exploded plan view of the handle of the plunger rake of FIG. 2.
Figure 12:
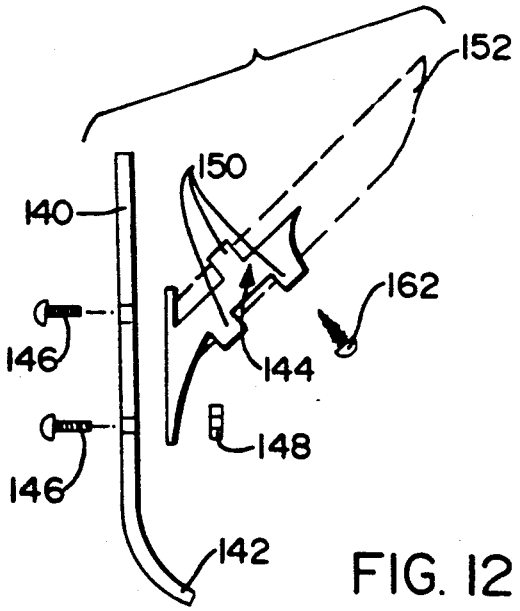
FIG. 12 is an exploded, side elevational view of the plunger rake of FIG. 11.

For use in conjunction with the present invention, a plunger rake 138 is provided. Plunger rake 138 includes a substantially semi-circular plate 140 having rounded teeth 142 along the lower straight edge thereof, which are inclined rearwardly toward the user during operation, as best shown in FIGS. 11 and 12. A handle bracket 144 is mounted by bolts 146 extending through plate 140 and corresponding nuts 148, to the rear surface of plate 140 at an upward angle thereto. Bracket 144 includes conventional capturing means 150 for holding a broom-type handle 152 therein. For ease of shipping and storage, broom-type handle 152 can be provided by two handle parts 154 and 156, each containing a dowel 158 and with a metal tube 160 or the like frictionally receiving the dowels 158 to secure the two handle parts together. In addition, broom-type handle 152 can be secured to bracket 144 by a set screw 162 or the like.

In operation, a person uses plate 140 and teeth 142 thereon to rake leaves, grass and the like into a pile by a pulling motion of plunger rake 138, that is, pulling plunger rake 138 towards the person. Thereafter, leaf directing element 12 is arranged adjacent to the pile and the opposite front surface of plunger rake 138 is used to force or push the pile of leaves, grass and the like into funnel section 14 of leaf directing element 12 so as to compact the pile in netting material 80. As netting material 80 feeds outwardly from leaf directing element 12, the leaves, grass and the like are compacted therein. When a sufficient size bag has been achieved, the netting material 80 is cut away from leaf directing element 12 and tied closed for disposal.

Having described a specific preferred embodiment of the invention with reference to the accompanying drawings, it will be appreciated that the present invention is not limited to that precise embodiment, and that various changes and modifications can be effected therein by one of ordinary skill in art without departing from the spirit or scope of the invention as defined in the appended claims.

What is claimed is:

1. A device for compacting and containing compactible material, comprising:

a directing element having an entrance funnel section which converges into an exit section of smaller dimensions than said entrance funnel section;

clamp means for releasably clamping a netting material on said exit section with a resistance force which permits withdrawal of the netting material during use from between said clamp means and said exit section of said directing element, said clamp means including clamp strap means for clamping said netting material on said exit section and means for varying the pressure of said clamp strap means on said exit section to permit withdrawal of the netting material with a selected resistance force; and restraining means for securing said clamp means on said directing element, said restraining means being connected between said directing element and said clamp means, wherein said means for varying includes a cord, first securing means for securing said cord to one end of said clamp strap means a second securing means for securing said cord at any of a plurality of different positions at the opposite end of said clamp strap means.

2. A device according to claim 1, wherein said cord is made of an elastic material.

3. A device according to claim 1 wherein said funnel section includes an enlarged entrance opening.

4. A device for compacting and containing compactible material, comprising:

(a) a directing element having an entrance funnel section which converges into an exit section of smaller dimensions than said entrance funnel section;

(b) clamp means for clamping a netting material on said exit section, said clamp means including (i) clamp strap means for clamping said netting material on said exit section and (ii) means for varying the pressure of said clamp strap means on said exit section, said means for varying including (A) a cord, (B) first securing means for securing said cord to one end of said clamp strap means and (C) second securing means for securing said cord at any of a plurality of different positions at the opposite end of said clamp strap means, said second securing means including a plurality of securing tabs formed on said opposite end of said clamp strap means and extending in the lengthwise direction of said clamp strap means; and restraining means for securing said clamp means on said directing element, said restraining means being connected between said directing element and said clamp means.

5. A device for compacting and containing compactible material, comprising:

a collapsible directing element having an entrance funnel section which converges into an exit section of smaller dimensions than said entrance funnel section; and clamp means for releasably clamping a netting material on said exit section with a resistance force which permits withdrawal of the netting material during normal operation from between said clamp means and said exit section of said directing element, said claim means including clamp strap means for clamping said netting material on said exit section and means for varying the pressure of said clamp strap means on said exit section to permit withdrawal of the netting material with a selected resistance force, wherein said collapsible directing element is formed from a base panel having opposite side edges and first and second side panels hingedly connected with said base panel at said side edges.

6. A device according to claim 5, wherein said side panels and said base panel are integrally formed and are connected along respective fold lines therebetween.

7. A device according to claim 5, wherein said first side panel includes a rear section hingedly secured to said base panel and a front section adjacent to and spaced from said base panel, and said second side panel includes a rear section hingedly secured to said base panel and a front section adjacent to and spaced from said base panel.

8. A device for compacting and containing compactible material, comprising:

a collapsible directing element having an entrance funnel section which converges into an exit section of smaller dimensions than said entrance funnel section, said collapsible directing element being formed from a base panel having opposite side edges and first and second side panels hingedly connected with said base panel at said side edges, said first side panel including first and second opposite side edges, said first side edge being connected with one said side edge of said base panel, said first side panel further including at least one opening adjacent said second side edge thereof; and said second side panel including first and second side edges, said first side edge being connected with the other side edge of said base panel, said second side panel further including at least one securing tab means adjacent said second side edge thereof for insertion within said at least one opening of said first side panel to secure said second sides of said first and second side panels together; and clamp means for clamping netting material on said exit section.

9. A device according to claim 8, wherein each said tab means includes at least one foldable wing means for insertion through said at least one opening in said first side panel with the respective tab means, in order to removably retain said at least one tab means therein.

10. A device for compacting and containing compactible material, comprising:

a collapsible directing element having an entrance funnel section which converges into an exit section of smaller dimensions than said entrance funnel section, said collapsible directing element being formed from a base panel having opposite side edges and first and second side panels hingedly connected with said base panel at said side edges, said first side panel having a first side edge connected with one said side edge of said base panel, an opposite second side edge and at least one opening adjacent said second side edge thereof; said second side panel including a first side edge connected with the other side edge of said base panel, a second opposite side edge and at least one opening adjacent said second side edge thereof for alignment with said at least one opening of said first side panel when said first and second side panels are hinged about said base panel; and bolt means insertible through said openings of said first and second side panels for securing said first and second side panels together; and clamp means for clamping netting material on said exit section.

11. A device for compacting and containing compactible material, comprising:

a collapsible directing element having an entrance funnel section which converges into an exit section of smaller dimensions than said entrance funnel section, said collapsible directing element being formed from a base panel having opposite side edges and first and second side panels hingedly connected with said base panel at said side edges, said first side panel including a rear section hingedly secured to said base panel and a front section adjacent to and spaced from said base panel, and said second side panel including a rear section hingedly secured to said base panel and a front section adjacent to and spaced from said base panel, said base panel including opposite side edges and an opening adjacent each said side edge, and said front section of each said side panel including tab means for engagement within said openings of said base panel to removably secure said front sections of said first and second side panels to said base panel; and clamp means for clamping netting material on said exit section.

12. A device for compacting and containing compactible material, comprising:

a directing element having an entrance funnel section which converges into an exit section of smaller dimensions than said entrance funnel section, said directing element including a base section extending along and as part of said entrance funnel section and said exit section and which supports said device, said base section including securing means thereon;

clamp means for clamping a netting material on said exit section; and elongated means for preventing movement of said directing element during a compacting operation, said elongated means having a first end connected to said securing means of said directing element and a second free end extending forwardly of said entrance funnel section and which can be engaged by a person for preventing movement of said directing element, said elongated means includes cord means having one end secured to said base section by said securing means and an opposite free end for preventing movement of said directing element when a person engages said free end of said cord means.

13. A device according to claim 12, wherein said securing means includes an opening in said base section; and said cord means has said one end secured to said base section at said opening.

14. A device for compacting and containing compactible material, comprising:

a collapsible directing element having an entrance funnel section which converges into an exit section of smaller dimensions than said entrance funnel section, said directing element including a base section extending along and as part of said entrance funnel section and said exit section and which supports said device, said base section including securing means thereon;

clamp means for clamping a netting material on said exit section;

restraining means for securing said clamp means on said directing element, said restraining means being connected between said directing element and said clamp means; and elongated means for preventing movement of said directing element during a compacting operation, said elongated means having a first end connected to said securing means of said directing element and a second free end extending forwardly of said entrance funnel section and which can be engaged by a person for preventing movement of said directing element, said elongated means includes cord means having one end secured to said base section by said securing means and an opposite free end for preventing movement of said directing element when a person engages said free end of said cord means.

* * * * *